US005245749A

United States Patent [19]

Couch, Jr.

[11] Patent Number: 5,245,749

[45] Date of Patent: Sep. 21, 1993

[54] WIRE WRAPPING AND UNWRAPPING KIT

[76] Inventor: Donald J. Couch, Jr., 1337 Fairmont Dr., Vinton, Va. 24179

[21] Appl. No.: 944,285

[22] Filed: Sep. 14, 1992

[51] Int. Cl.[5] ..... H01R 43/00; B21F 3/04

[52] U.S. Cl. ..... 29/751; 7/107; 29/762; 140/124

[58] Field of Search ..... 29/566.4, 762, 764, 29/752, 751, 750; 140/122, 123, 124; 242/7.17; 7/107; 81/426

[56] References Cited

U.S. PATENT DOCUMENTS

| | | | |
|---|---|---|---|
| 2,804,887 | 9/1957 | Reck | 140/123 |
| 2,836,837 | 6/1958 | Belek | 7/107 |
| 3,019,517 | 2/1962 | Lovecky | 140/124 |
| 3,318,344 | 5/1967 | Lamoureux | 140/124 |
| 3,521,678 | 7/1970 | Petree | 29/762 X |
| 3,552,452 | 1/1971 | Stigall | 140/124 |
| 3,866,846 | 2/1975 | Dorsey | 29/762 X |
| 3,994,320 | 11/1976 | Dorsey et al. | 29/566.4 X |
| 4,064,581 | 12/1977 | Kober | 29/764 |
| 4,444,228 | 4/1984 | Demirjiain | 140/123 |
| 4,625,774 | 12/1986 | Stack, Jr. | 140/123 |

FOREIGN PATENT DOCUMENTS

| | | | |
|---|---|---|---|
| 1124045 | 5/1982 | Canada | 140/124 |
| 2845279 | 5/1979 | Fed. Rep. of Germany | 29/762 |

OTHER PUBLICATIONS

"Unwrapping Tool" W. E. Technical Digest No. 42 Apr. 1976 p. 35.

*Primary Examiner*—William Briggs
*Attorney, Agent, or Firm*—Leon Gilden

[57] ABSTRACT

A kit organization includes a first tool member and a second tool member arranged for the selective wrapping and unwrapping of wire relative to a post, wherein the wrapping tool includes a longitudinal groove directed along an exterior surface of the tool having a cylindrical body, with a central bore, and a sleeve positioned over the body to secure the wire fed along the groove relative to the post, whereupon subsequent to a wrapping procedure, the body is directed onto the post to secure and tighten the coils about the post. The unwrapping tool includes a helical groove cooperative with a locking finger to receive a wire and direct the wire about the groove in an unwrapping procedure.

5 Claims, 4 Drawing Sheets

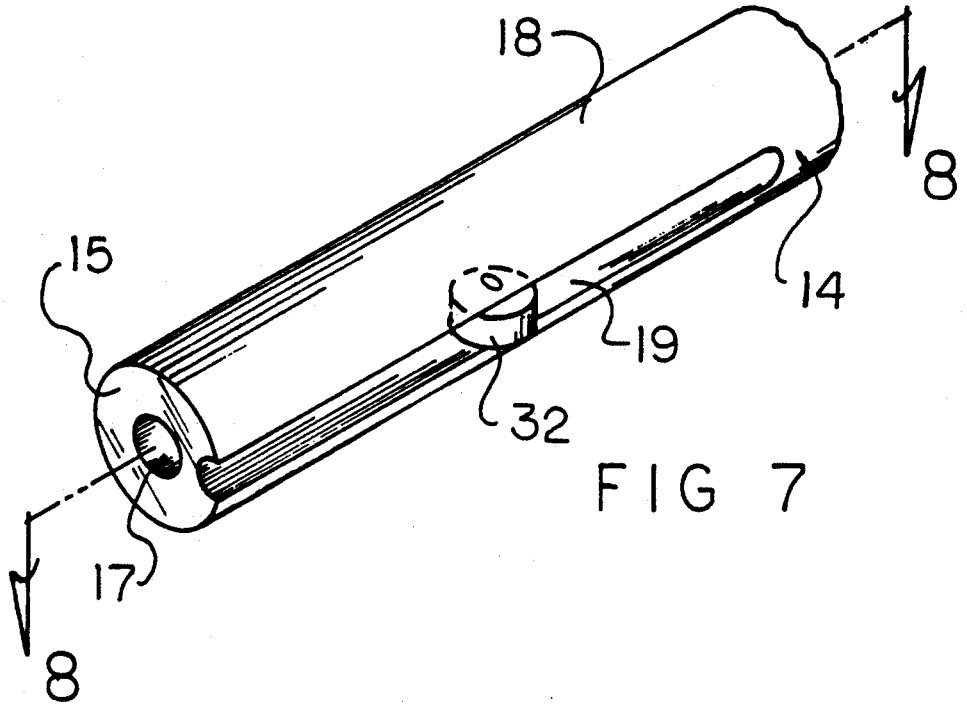
FIG 7
FIG 8
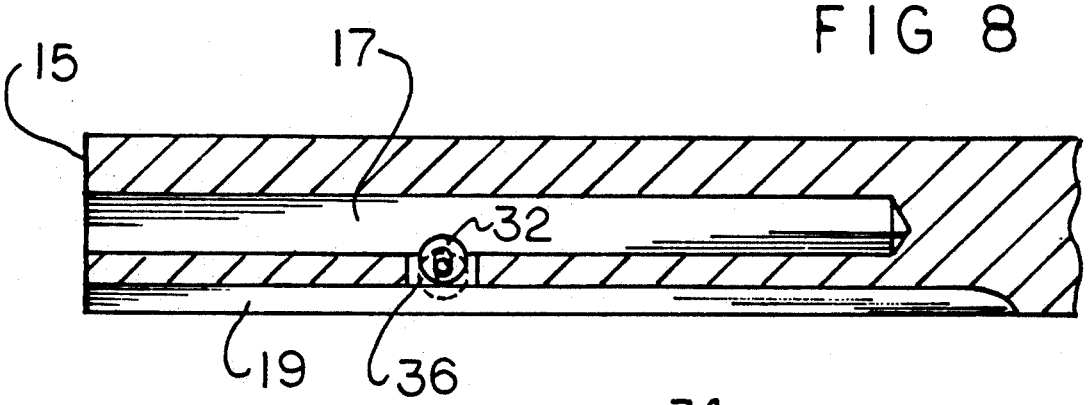
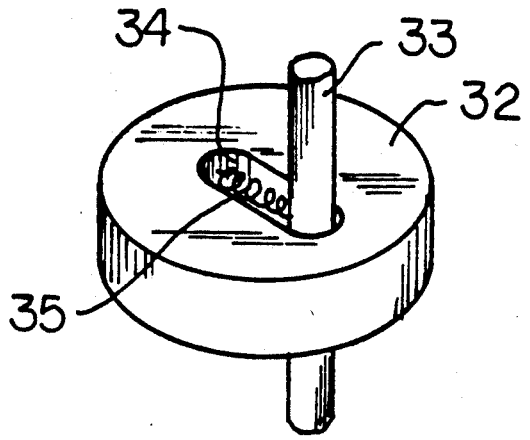
FIG 9

WIRE WRAPPING AND UNWRAPPING KIT

BACKGROUND OF THE INVENTION

1. Field of the Invention

The field of invention relates to wrapping and unwrapping wire tool structure, and more particularly pertains to a new and improved wire wrapping and unwrapping kit wherein the same is arranged for the selective securement and detachment of wire relative to a post member.

2. Description of the Prior Art

Wire wrapping tools of various types have been utilized in the prior art when wire is wrapped around tags relative to a printed circuit board to effect electrical communication between relative portions of the printed circuit board by machine or manually. For example, the U.S. Pat. Nos. 4,425,948; 5,036,578; 3,994,320; and 4,305,550 are all examples of wire wrapping tools utilized in the prior art for this procedure.

The instant invention attempts to overcome deficiencies of the prior art by providing for a compact kit structure incorporating wrapping and unwrapping tools to permit the selective wrapping and unwrapping of wire about a post member and in this respect, the present invention substantially fulfills this need.

SUMMARY OF THE INVENTION

In view of the foregoing disadvantages inherent in the known types of wire wrapping apparatus now present in the prior art, the present invention provides a wire wrapping and unwrapping kit wherein the same utilizes a plurality of tools to permit the ease of wrapping and unwrapping wire relative to a conductive circuit board. As such, the general purpose of the present invention, which will be described subsequently in greater detail, is to provide a new and improved wire wrapping and unwrapping kit which has all the advantages of the prior art wire wrapping and unwrapping tool apparatus and none of the disadvantages.

To attain this, the present invention provides a kit organization including a first tool member and a second tool member arranged for the selective wrapping and unwrapping of wire relative to a post, wherein the wrapping tool includes a longitudinal groove directed along an exterior surface of the tool having a cylindrical body, with a central bore, and a sleeve positioned over the body to secure the wire fed along the groove relative to the post, whereupon subsequent to a wrapping procedure, the body is directed onto the post to secure and tighten the coils about the post. The unwrapping tool includes a helical groove cooperative with a locking finger to receive a wire and direct the wire about the groove in an unwrapping procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wire wrapping and unwrapping kit which has all the advantages of the prior art wire wrapping and unwrapping tool apparatus and none of the disadvantages.

It is another object of the present invention to provide a new and improved wire wrapping and unwrapping kit which may be easily and efficiently manufactured and marketed.

It is a further object of the present invention to provide a new and improved wire wrapping and unwrapping kit which is of a durable and reliable construction.

An even further object of the present invention is to provide a new and improved wire wrapping and unwrapping kit which is susceptible of a low cost of manufacture with regard to both materials and labor, and which accordingly is then susceptible of low prices of sale to the consuming public, thereby making such wire wrapping and unwrapping kits economically available to the buying public.

Still yet another object of the present invention is to provide a new and improved wire wrapping and unwrapping kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the wire wrapping tool body utilizing a brake wheel.

FIG. 8 is an orthographic view, taken along the lines 8—8 of FIG. 7 in the direction indicated by the arrows.

FIG. 9 is an isometric illustration, somewhat enlarged, of the brake wheel structure.

DESCRIPTION OF THE PREFERRED EMBODIMENT

Figures 1, 2, 3, 4:
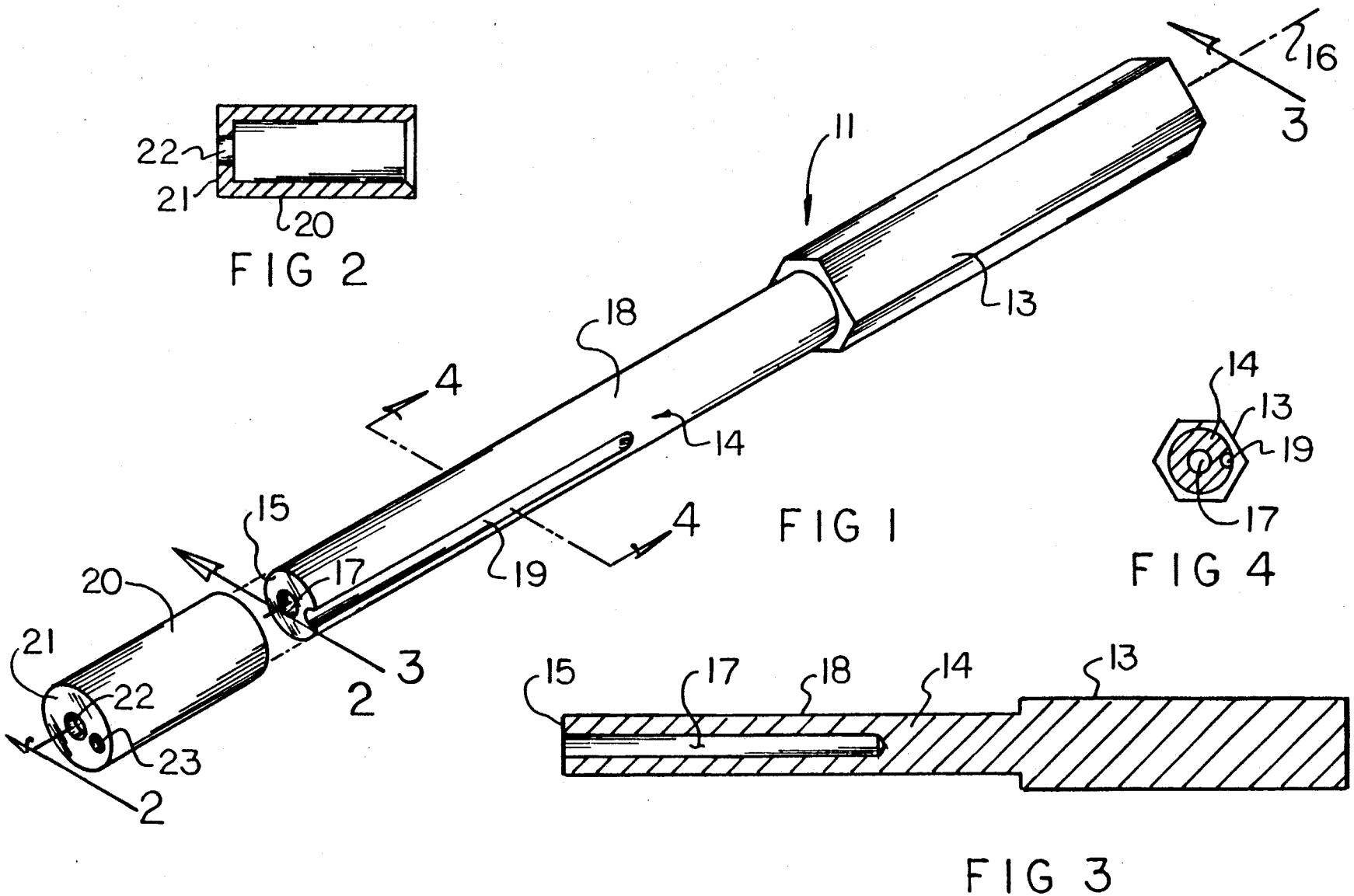
FIG. 1 is an isometric illustration of the wire wrapping tool of the invention.
FIG. 2 is an orthographic view, taken along the lines 2—2 of FIG. 1 in the direction indicated by the arrows.
FIG. 3 is an orthographic view, taken along the lines 3—3 of FIG. 1 in the direction indicated by the arrows.
FIG. 4 is an orthographic view, taken along the lines 4—4 of FIG. 1 in the direction indicated by the arrows.

With reference now to the drawings, and in particular to FIGS. 1 to 10 thereof, a new and improved wire wrapping and unwrapping kit embodying the principles and concepts of the present invention and generally designated by the reference numeral 10 will be described.

Figure 5:
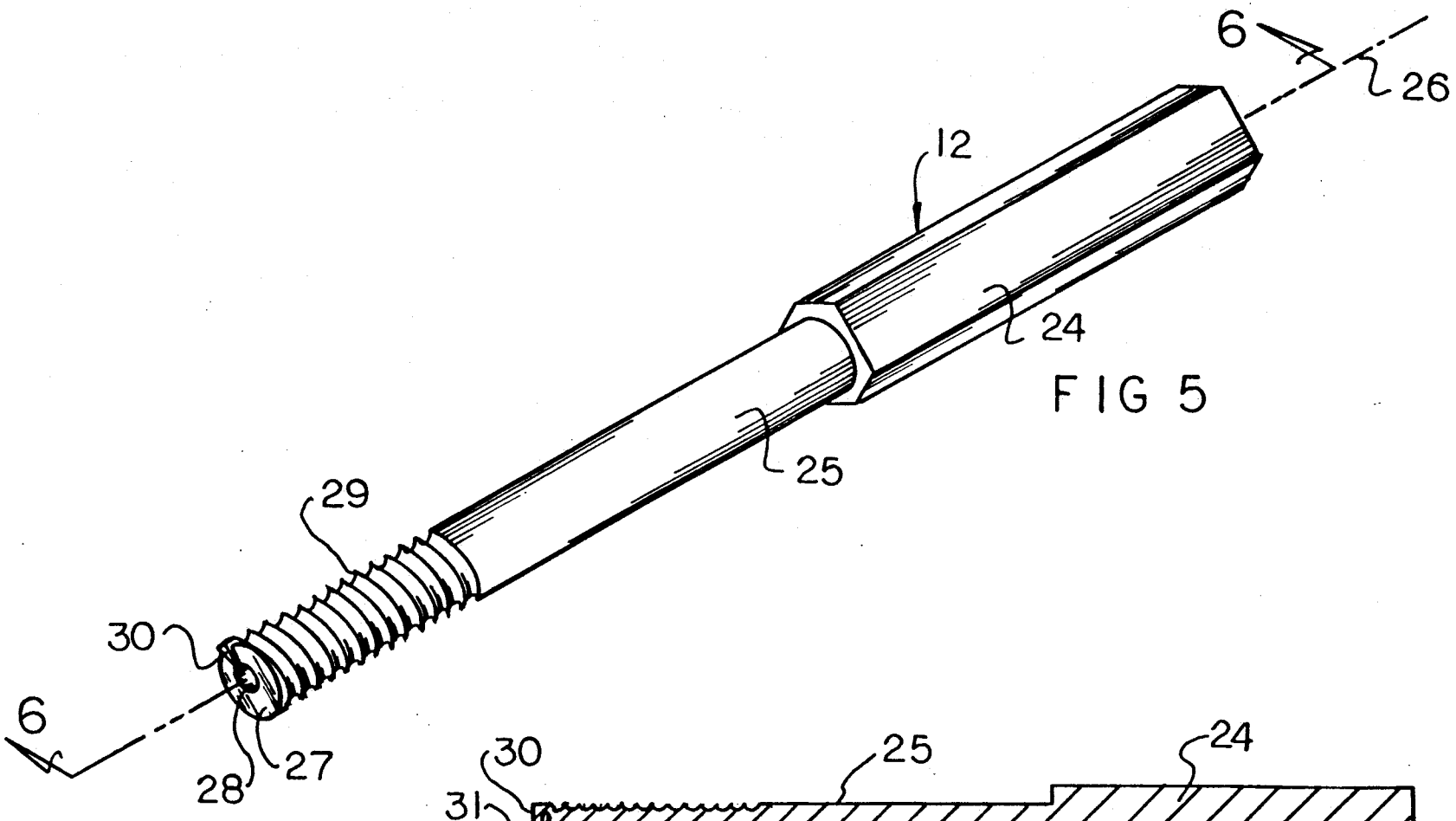
FIG. 5 is an isometric illustration of the wire unwrapping tool of the invention.
Figure 6:
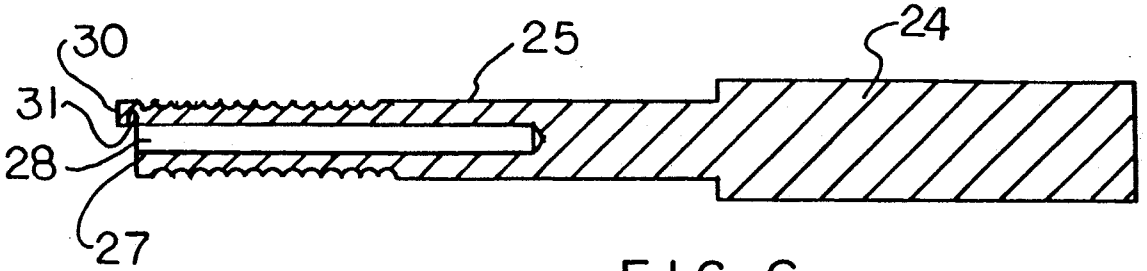
FIG. 6 is an orthographic view, taken along the lines 6—6 of FIG. 5 in the direction indicated by the arrows.

More specifically, the wire wrapping and unwrapping kit 10 of the instant invention essentially comprises a first tool member 11, as indicated in FIG. 1, and a second tool member 12, as indicated in the FIG. 5.

The first tool member 11 includes a first polygonal shank 13 arranged for reception within the collet portion of a conventional reversible drill member 37. The first shank 13 is coaxially aligned relative to an elongate first body 14 along a first axis 16, with the first body end wall 15 orthogonally oriented relative to the axis 16 at a free distal end of the first body spaced from the shank 13. A first body bore 17 is directed into the first body 14 from the first body end wall 15 along the axis 16 spaced from the shank 13. The first body has an exterior cylindrical wall 18 to include a first body groove 19 directed along the exterior wall 18 parallel to the axis 16 and the first body bore 17. The first body groove 19 is arranged to guide and direct wire (not shown), in a manner as indicated and described in U.S. Pat. No. 5,036,578.

Figure 10:
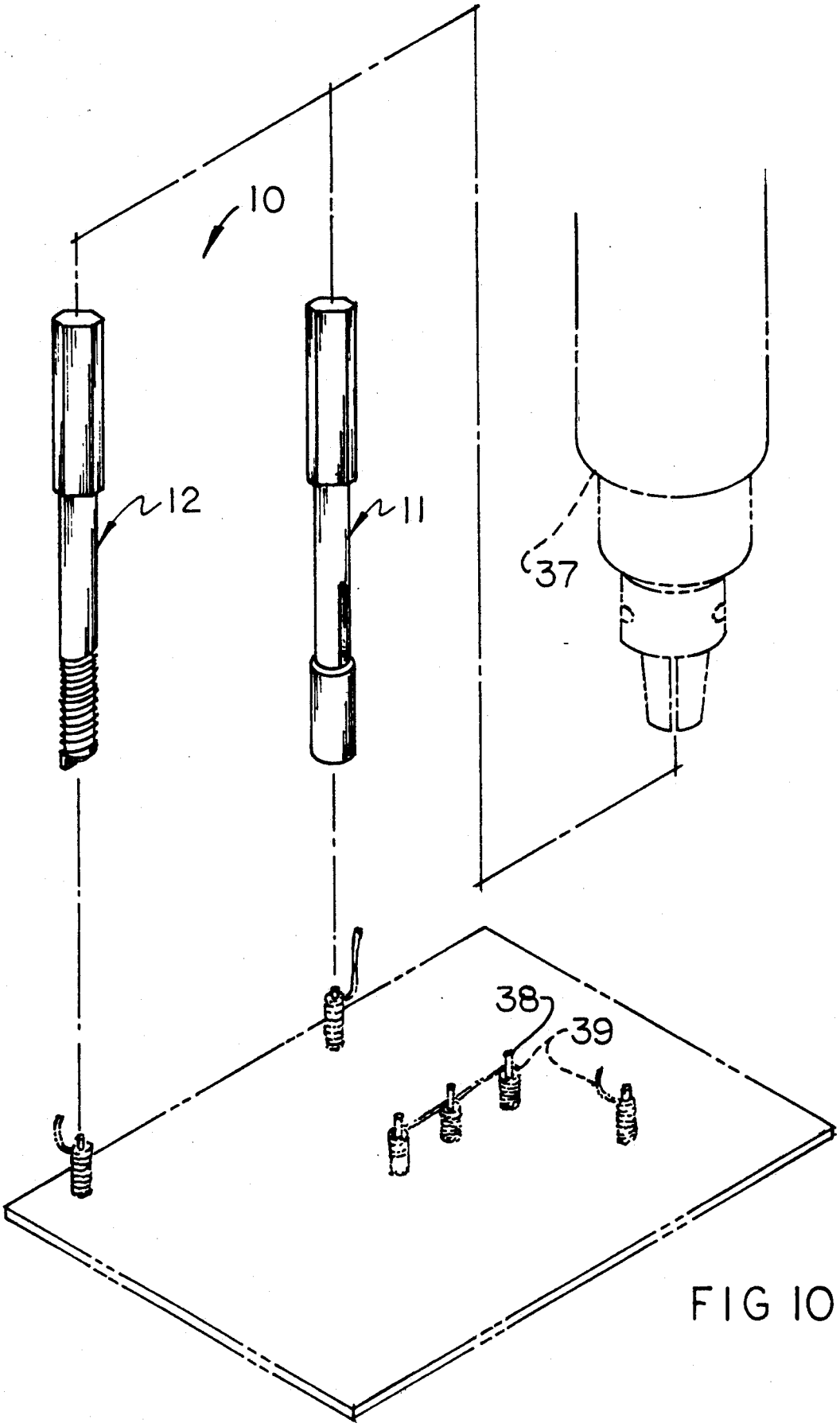
FIG. 10 is an isometric illustration of the kit relative to a rotary and reversible drill member.

A wire wrapping scenario is indicated in the FIG. 10 to direct a wrapped wire 39 about a terminal post 38.

A cylindrical sleeve 20 is provided having a sleeve cavity to receive the first body 14 therewithin, with the cylindrical sleeve 20 including a cylindrical sleeve end wall 21 having an end wall first bore 22 coaxially aligned with the first body bore 17 and an end wall second bore 23 arranged for alignment with the groove 19. The sleeve is arranged to secure and position the wire within the groove 19 providing for ease of directing the wire along the groove to be subsequently fed through the second bore 23. In this manner when the post portion 38 is directed through the first bore 22, and the tool rotated by use of the drill member 37, the wire fed along the groove 19 and through the second bore 23 effects wrapping of the wire about the post in use, in a manner as indicated in FIG. 10.

The second tool 11 is arranged as an unwrapping tool of the kit assembly, and includes a second shank 24 also of polygonal construction arranged for reception within the drill member 37, as required during an unwrapping procedure. A second body 25 is coaxially aligned relative to the second shank 24 along the second axis 26, with the second body 25 having a second body end wall 27 orthogonally oriented relative to the axis 26 at a free distal end of the second body 25 spaced from the second shank 24. The second body end wall includes a second body bore 28 coaxially aligned along the second axis 26, with a spiral groove 29 directed from the second body end wall 27 along the exterior surface of the second body 25. A tooth plate 30 is arranged parallel to and overlying the second body end wall 27, and extending from the exterior surface of the second body 25 to position in adjacency relative to the second body bore 28. A gripping slot 31 is thereby effected between the tooth plate 30 and the second body end wall 27 to secure the wire permitting its subsequent unwrapping relative to the post 38.

The FIGS. 7-9 indicates the use of a modified second tool portion 11, wherein the first body exterior wall 18 and more particularly the groove 19 includes a brake wheel 32 rotatably mounted therewithin. The brake wheel 32 is rotatable about a brake wheel axle 33 orthogonally directed through the brake wheel and fixedly mounted within a wheel slot 36 at a partition wall between the first body bore 17 and the groove 19, as indicated in FIG. 8. The axle is mounted within an axle slot 34 directed within the wheel and wherein the axle slot 34 is fully enclosed within the wheel and is aligned along a diameter of the wheel, with a wheel spring 35 biasing the axle 33 towards the axial center of the wheel to thereby force the wheel from the bore 17 to project towards the groove 19 to thereby capture a wire 39 between the wheel and the sleeve during use. The wheel merely provides for frictional positioning and engagement of the wire to prevent its entangling and kinking relative to the tool structure 11 in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wire wrapping and unwrapping kit, comprising, a first tool member and a second tool member, wherein the first tool member includes a first shank and a first body extending from the shank, wherein the first body and the first shank are symmetrically oriented about a first axis, and the first body includes a first body end wall orthogonally oriented relative to the first axis, and a first body bore extending into the first body from the first body end wall along the first axis, and the first body having a first body exterior wall surface, and a first groove directed along the first body exterior wall surface parallel to the first bore and extending from the first body end wall, and the second tool having a second shank and a second body coaxially aligned along the second shank symmetrically oriented about a second axis, and the second body having a second body end wall orthogonally oriented relative to the second axis, and a second body bore directed into the second body extending from the second body end wall along the second axis, and a tooth plate fixedly mounted to the second body oriented parallel to and spaced from the second body end wall defining a gripping slot between the tooth plate and the second body end wall.

2. A kit as set forth in claim 1 wherein the first tool member includes a cylindrical sleeve, the cylindrical sleeve having a cylindrical sleeve cavity slidably receiving the first tool member therewithin, and the cylindrical sleeve including a cylindrical sleeve end wall, the cylindrical sleeve end wall including an end wall first bore coaxially aligned with the first bore, and the sleeve end wall having an end wall second bore coaxially aligned with the groove.

3. A kit as set forth in claim 2 wherein the second tool member includes a spiral groove extending from the second body end wall about the second end body.

4. A kit as set forth in claim 3 wherein the first tool member includes a first body wall oriented between the groove and the first body bore, and the wall having a wheel slot directed therethrough communicating the first bore with the groove, and a brake wheel rotatably mounted within the wheel slot.

5. A kit as set forth in claim 4 wherein the brake wheel includes a brake wheel axle, the brake wheel axle fixedly mounted within the wheel slot, and the brake wheel having a diametrically aligned axle slot having the brake wheel axle directed therethrough, and a spring mounted between the brake wheel axle and a radial center of the brake wheel to bias the brake wheel into the groove for engagement of a wrap wire between the brake wheel and the cylindrical sleeve, wherein the cylindrical sleeve is mounted on the first body.

* * * * *